US005788612A

United States Patent [19]

Rennick

[11] Patent Number: 5,788,612

[45] Date of Patent: Aug. 4, 1998

[54] REACTIVE MEANS FOR A PUNCHING BAG

[75] Inventor: Mark Rennick, Marietta, Ga.

[73] Assignee: A Leap Ahead, Incorporated, Atlanta, Ga.

[21] Appl. No.: 443,087

[22] Filed: May 17, 1995

[51] Int. Cl.[6] ..... A63B 69/24

[52] U.S. Cl. ..... 482/83; 482/87; 482/90

[58] Field of Search ..... 482/83–90

[56] References Cited

U.S. PATENT DOCUMENTS

| | | | |
|---|---|---|---|
| 410,475 | 9/1889 | Widger | 482/90 |
| 519,918 | 5/1894 | MacLearn | 482/90 |
| 524,894 | 8/1894 | Forsberg | 482/90 |
| 547,731 | 10/1895 | MacLearn | 482/90 |
| 808,528 | 12/1905 | Finney | 482/90 |
| 925,342 | 6/1909 | Johnson | 482/90 |
| 1,665,969 | 4/1928 | McNamara | 482/90 |
| 1,703,012 | 2/1929 | McNamara | 482/90 |
| 1,890,696 | 12/1932 | Rosenhahn | 482/90 |
| 2,009,040 | 7/1935 | Beach | 482/90 |
| 2,184,453 | 12/1939 | Hayes | 482/90 |

*Primary Examiner*—Jerome Donnelly

[57] ABSTRACT

A reactive means for a punching bag comprising a shaft for mounting the bag, a resinous resilient bearing and housing through which the shaft passes and in which the shaft pivots, an adjustable pressure plate for imparting a damping effect upon the motion of the bag by compressing the resinous bearing, and a supporting structure. Also disclosed are optional attachments of reactive and motivative devices to the shaft such as springs, weights, and fluid activated cylinders. The effect of the resinous bearing, and the reactive and motivative means attached to the shaft, is to cause the movement of the bag to mimic that of a human opponent.

18 Claims, 6 Drawing Sheets

REACTIVE MEANS FOR A PUNCHING BAG

FIELD OF THE INVENTION

This invention relates to the field of martial arts, including boxing, and more particularly to an apparatus useful in providing reactive effect and motion damping to a punching bag used in the execution of martial arts kicking and punching techniques.

BACKGROUND OF THE INVENTION

The martial arts are usually considered to include any of several oriental arts of combat, or self-defense, such as karate, judo, or tae kwon do, but may more generally include boxing. Many devices have been developed to facilitate training in this field. Among these are punching bags attached to a movable standard or shaft which is itself attached to a fixed base through a movable joint or flexible mounting in such a way as to allow reactive motion to be imparted to the shaft and thus to the bag. For example, U.S. Pat. No. 519,918, issued to McLearn, discloses a leather covered bag attached to a shaft which is, in turn, attached to one end of a coil spring the other end of which is mounted on a cast iron base. In this simple device the vertical coil spring serves both as the movable mounting and the reactive means. In U.S. Pat. No. 1,703,012, issued to McNamara, there is disclosed a bag whose shaft terminates in a ball which rocks about a fixed horizontal plate as the bag is struck and which returns the shaft and bag to the vertical starting position due to tension imposed by a coil spring passing through a hole in the fixed plate and attaching to the underside of the ball. A later device is disclosed in U.S. Pat. No. 1,890,696, issued to Rosenhahn, in which the shaft passes through a fixedly mounted gimbal bearing and terminates by connecting to the ends of four coil springs, aligned at right angles with respect to each other and to the resting shaft, providing reactive means to the shaft and eventually returning the shaft to the vertical position, at rest.

All such prior art upright floor mounted punching bag devices are lacking in damping mechanisms which attenuate, or damp, the oscillations of the bag. Such damping is desirable so as to cause the movement of the bag to better imitate that of a human opponent.

The prior art provides only for metal-to-metal bearings or heavy springs as the movable joint between the bag and the fixed base. Such joints are generally not adjustable and may require lubrication periodically.

The prior art generally does not provide limiting means which define the maximum displacement of the bag from its vertical resting position.

The prior art generally does not provide for ready adjustment of the reactive means so as to increase or lessen the force required to displace the bag from its resting position. The present invention attempts to address all these limitations.

SUMMARY OF THE INVENTION

The present invention addresses the forgoing shortcomings by providing a resinous, resilient bearing along with an associated housing through which the bag shaft passes and by virtue of which the limit and locus of movement of the striking bag is defined and its motion is damped or slowed. A principal rebound means, attached to the lower end of the shaft, as well as the bearing itself, are located for easy access and may be readily adjusted for optimal performance.

The resinous resilient bearing may be cast or molded from a number of different materials including, but not limited to, a synthetic plastic material such as polyurethane, or a natural material such as rubber.

The resinous resilient bearing, and its housing, are constructed in such a way that the damping effect imparted to the shaft is easily adjusted by nuts, or other compression means, such nuts or compression means acting against a pressure plate which in turn acts on the resilient bearing such that the applied pressure is transmitted to the surface of the shaft through the plastic deformation of the bearing material. The interaction between the pressurized bearing and the shaft restrains the movement of the shaft, giving rise to the desired damping effect.

Although some rebound effect is imparted to the shaft, and hence to the bag, by the action of the bearing, the principal rebound means will, in practice, be provided by weights, resilient members such as springs and elastic bands, or other means attached to the lower end of the shaft as further described herein.

The principal object of the invention is an adjustable, resinous resilient bearing with its housing and supporting structure, along with a rigid shaft, the mid-section of which is held within the bearing and the upper section of which is imbedded in a punching bag, such that motion imparted to the shaft by a blow to the bag is damped by the action of the bearing on the shaft, such damping occurring independently of the force of the blow and independently of any reactive means attached to the lower end of the shaft.

Other objects of the invention are to limit the angular range of motion of the shaft, constrain the vertical movement of the shaft, and to fix the resting position of the shaft with respect to the supporting means. The angular limit of motion of the shaft is determined by the shaft aperture in the pressure plate, the size of the corresponding aperture in the bearing housing, and the distance between these two openings which is represented by the thickness of the bearing. These openings are somewhat larger than the shaft diameter, such that the shaft rides freely within the resinous resilient bearing, within it normal angular travel range, and only contacts and is stopped by the edges of the openings at the limit of its travel. A small annular ring attached to the shaft rides against the upper surface of the bearing preventing the shaft from working its way downward, in use. This ring is small enough to accomplish its purpose without interfering with the action of the bearing and its housing. The bearing and housing will, in practice, be mounted on a supporting structure such that the openings in housing and pressure plate, as well as the shaftway of the bearing, will be aligned vertically.

A further object of the present invention is to provide for easy exchange of the resinous resilient bearings of varying durometer allowing the user to optimize bag performance to a particular exercise. It will be readily apparent that harder or less resilient bearings will have a greater damping effect on the movement of the bag while softer bearings will allow faster travel and freer oscillation of the bag.

A further object of the present invention allows for ready attachment of weights to the lower end of the shaft in order to affect the reactive performance of the bag. Such weights may include a shot bucket or other loading means as will be readily apparent to one of ordinary skill.

A further object of the present invention allows for the attachment of one or more resilient members, such as springs or elastic bands, to the lower end of the shaft, linking the shaft to the supporting structure, such that movement of the shaft will cause elongation of the resilient members, resulting in primary rebound force to the bag.

A yet further object of the invention is the attachment of a rigid cone shaped fixture to the lower end of the shaft, and the attachment of a resilient barrier, supported by a rigid backing, about the supporting structure such that the cone shaped fixture impinges upon and compresses the barrier as the bag, and thus the shaft, is moved toward the limit of its range. The subsequent decompression of the barrier supplies a rebounding force to the shaft and bag. The barrier may be constructed of a synthetic material such as polyurethane or a natural material such as rubber, and may take the form of a fluid filled bladder constructed of such materials.

Another object of the invention provides for motive force to the shaft and bag by means of an external power source. Such power source may be an electrically powered pneumatic or hydraulic pump supplying working fluid through control valving to one or more cylinders linking the supporting structure of the invention to the lower end of the shaft in such a way as to cause the shaft and bag to move independently of the blows thrown by the exercising user. Such control valving may be operated manually or may be activated electro-mechanically through a computer programmed for that purpose. This object provides for unexpected movement of the bag giving the exercising user a target which more closely mimics the movements of a human opponent. To further enhance this feature, the cylinders may be linked to the lower end of the shaft by resilient members, allowing the bag to respond to a blow while at the same time being moved in a different direction by the action of the cylinders. Such resilient members may include springs or elastic bands.

A still further significant object of the present invention is that the resinous resilient bearing, its housing, and the support structure is inexpensive to manufacture and is yet durable to a high degree in use.

Other objects, features and advantages of the present invention will become apparent by reference to the following detailed descriptions of preferred, but nonetheless illustrative, embodiments of the present invention, with reference to the accompanying drawings, wherein.

DETAILED DESCRIPTION OF THE PREFERRED EMBODIMENTS

Figure 1:
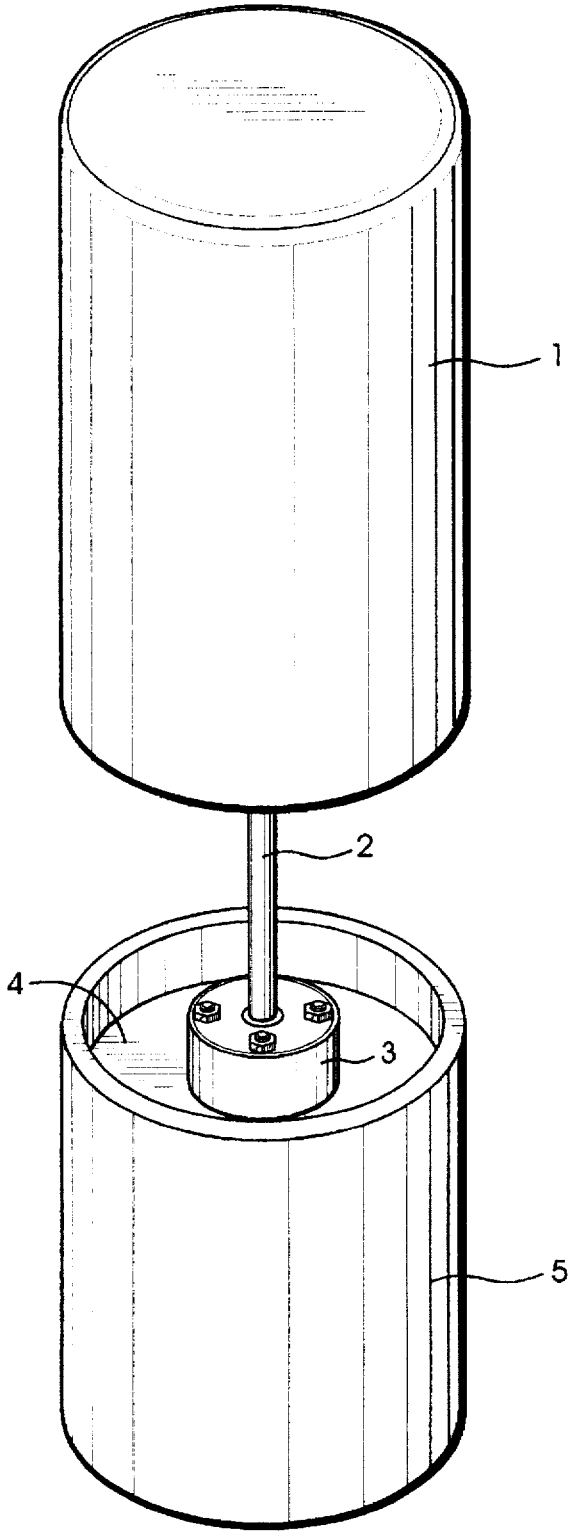
FIG. 1 is a perspective view of a complete punching bag device disclosing an embodiment of the invention.

Turning first to FIG. 1, there is shown a complete kicking and/or punching device including an embodiment of the present invention with principal rebound means hidden within a casing covering the supporting structure. Illustrated are bag 1, shaft 2, and bearing housing 3, containing the unexposed bearing, supporting structure upper plate 4, and protective cover 5.

Figure 2:
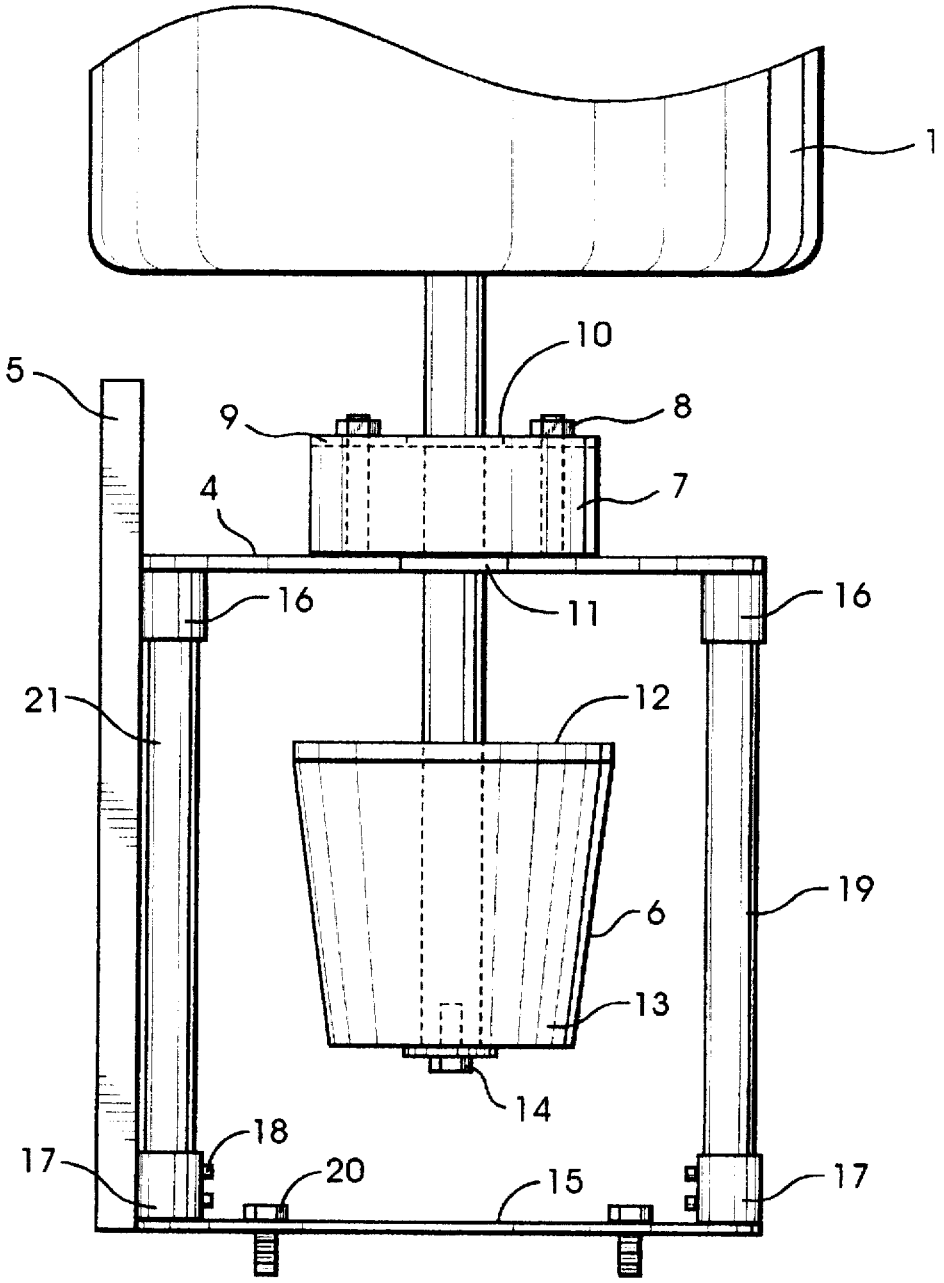
FIG. 2 is a sectional fragmentary view of an embodiment of the invention showing the resinous resilient bearing, bearing housing, and lower shaft with a shot bucket attached thereto, such shot bucket providing rebound force to the shaft.

Referring to FIG. 2, when the bag is struck by the user, a rebound force resisting movement of the bag and impelling return of the bag to its resting position is generated by the lifting of the shot bucket 6, against gravity. This lifting is accomplished as the shaft pivots in the resinous resilient bearing 7, causing the shot bucket to rise in an arc subtended by an angle equal to that of the bag displacement from the vertical. Further, the movement of the bag is damped by the action of the resinous resilient bearing on the shaft. This action is the result of the pressure applied to the shaft by virtue of the durometer or hardness of the bearing material and by the mechanically applied pressure, added thereto, through the action of the nuts 8, against the pressure plate 9. As the nuts are tightened, the rigid walls of the bearing housing restrain movement of the bearing material such that the pressure on the shaft is relieved effectively only by the bulging of the bearing material through the shaft apertures 10, and 11, and by slight expansion of the walls of the bearing housing. Shown also are shot bucket cover 12, lead shot 13, bucket securement bolt 14, upper and lower structural plates 4 and 15, respectively, threaded couplings 16, collars 17, set screws 18, structural posts 19, floor mounting lags 20, casing 21, and protective cover 5.

Figure 3:
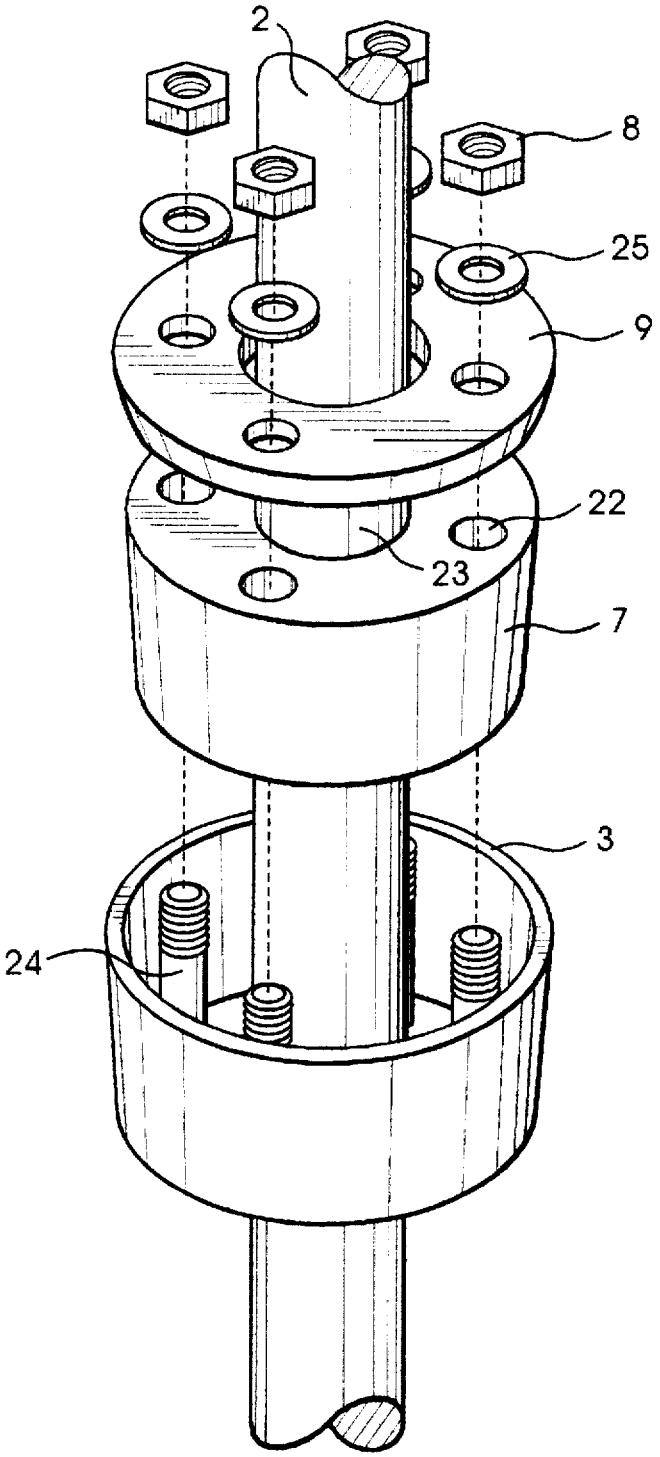
FIG. 3 is an isometric exploded view of an embodiment showing the resinous resilient bearing, its housing, pressure plate, shaft, pressure adjusting studs, washers and nuts.

Turning to FIG. 3, we show the preferred embodiment of the resinous resilient bearing 7, with stud holes 22, and shaftway 23. Also shown is shaft 2, pressure plate 9, bearing housing 3, complete with studs 24, washers 25, and nuts 8.

Figure 4:
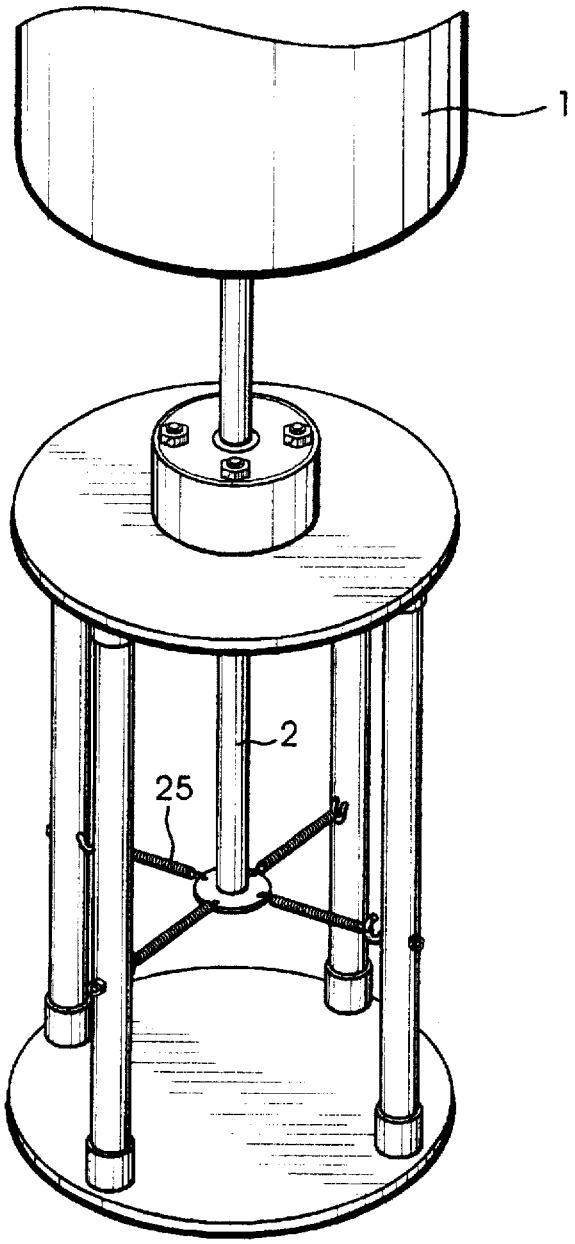
FIG. 4 is a perspective fragmentary view disclosing an embodiment of the invention with elastic bands attached to the lower shaft providing rebound force thereto.

Shown in FIG. 4, is an embodiment of the present invention utilizing flexible band or straps 25, connecting the end of the shaft 2, with the supporting structure. The bands impart the principal rebound force to the shaft by resistance to elongation as the shaft is moved.

Figure 5:
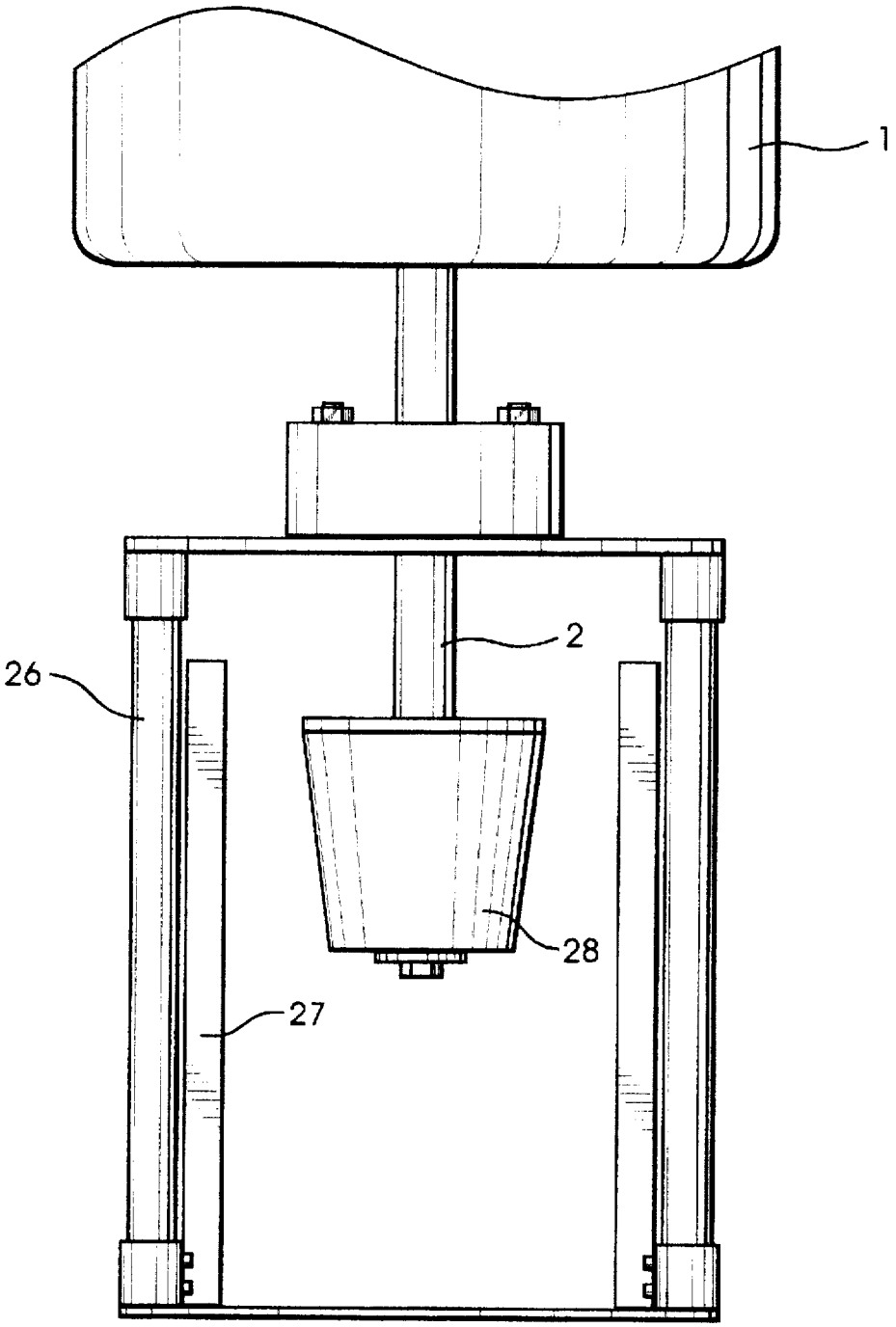
FIG. 5 is a sectional fragmentary view disclosing an embodiment of the invention with a resilient deformable material fixed cylindrically to the supporting structure of the device so as to provide rebound force thereto.

Turning to FIG. 5, it can be seen that the resilient barrier 26, backed by fixed plate 27, serves to generate the principal rebound force to the shaft 2, as the cone shaped fixture 28, impinges upon and compresses the barrier in this embodiment of the invention. This provides an interesting variation in the bag reaction in that the user encounters little or no resistance in the first moment of the blow followed by sudden resistance as the barrier is compressed.

Figure 6:
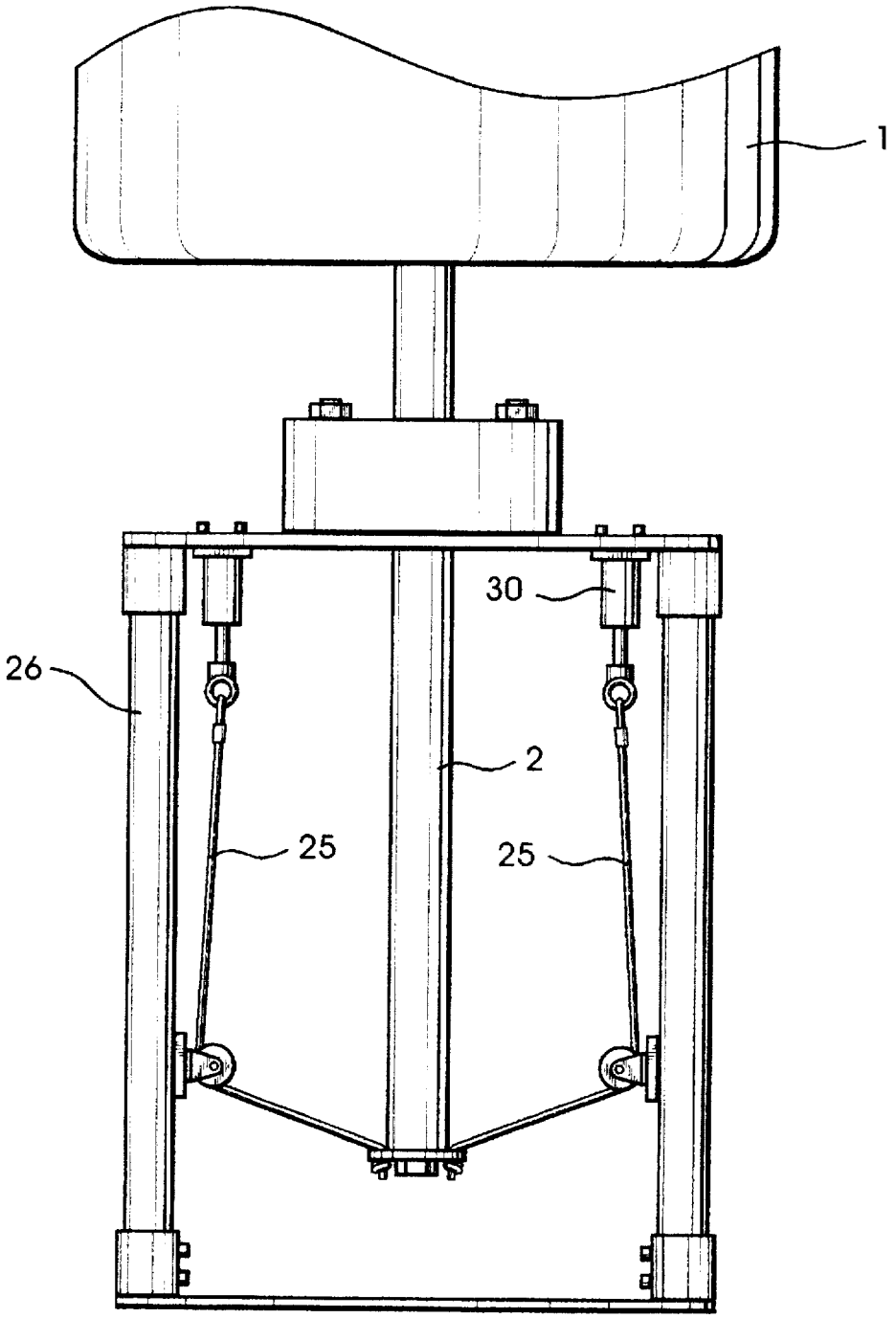
FIG. 6 is a perspective fragmentary view disclosing an embodiment of the invention wherein the motion of the shaft is influenced by an external power source which is activated independently of the exercising user.

FIG. 6, illustrates an embodiment of the invention wherein the principal rebound force to the shaft is provided by resistance to elongation of the elastic bands 25, as affected by both the action of the user, as in FIG. 4, as well as by the action of the cylinders 30, whose working fluid is motivated by a pump and circulated through valves to and from each cylinder, independently. The cylinders will generally be activated without warning to the user so as to evoke unexpected movement of the bag where such movement is deemed appropriate to training. The cylinders may be operated manually or may be operated in random and preprogrammed patterns through computer activation of the valving.

Variations in the design of the present invention and its embodiments will be readily apparent to those of ordinary skill in the art in light of the foregoing descriptions. Accordingly, it is intended to embrace all such alternatives, modifications, and variations as fall within the spirit and broad scope of the appended claims.

What is claimed is:

1. An improved reactive means for a punching bag comprising:

a housing;

a resinous, resilient bearing, positioned within said housing;

a rigid plate;

compression means for acting against said rigid plate, to thereby compress said bearing within said housing;

a shaft, configured to facilitate the attachment of a striking means on an upper end thereof, and having a lower end which passes through an aperture in each of said respective rigid plate, said bearing, and said housing;

a support structure supporting said housing, thereby supporting said bearing, said rigid plate, and said shaft within said bearing and;

a principal rebound means attached to said shaft substantially at said lower end thereof, wherein when said compression means is caused to compress said pressure plate against said resinous bearing, which is positioned within said housing, a restraining pressure is transmitted to the surface of the said shaft in an area where the said shaft passes through, and interacts with, the said resinous bearing.

2. The assembly of claim 1, wherein the said resinous bearing is a synthetic plastic material.

3. The assembly of claim 1, wherein the said resinous bearing is composed of polyurethane.

4. The assembly of claim 1, wherein the said resinous bearing is composed of rubber.

5. The assembly of claim 1, wherein the principle rebound means is a weight.

6. The assembly of claim 1, wherein the principal rebound means is one or more resilient members attached to the said supporting structure.

7. The assembly of claim 6, wherein the said one or more resilient members are elastic bands.

8. The assembly of claim 6, wherein the said one or more resilient members are springs.

9. The assembly of claim 1, wherein the principal rebound means is a substantially cone shaped fixture impinging upon a resilient barrier attached to the said supporting structure.

10. The assembly of claim 9, wherein the said resilient barrier is composed of a synthetic material.

11. The assembly of claim 9, wherein the said resilient barrier is composed of rubber.

12. The assembly of claim 9, wherein the said resilient barrier is a fluid filled bladder.

13. The assembly of claim 1, wherein the principal rebound means is one or more resilient members attached to externally powered means mounted on the said supporting structure.

14. The assembly of claim 13, wherein the said one or more resilient members are elastic bands.

15. The assembly of claim 13, wherein the said one or more resilient members are springs.

16. The assembly of claim 13, wherein the said externally powered means is one or more fluid activated cylinders.

17. The assembly of claim 13, wherein the said externally powered means is controlled manually.

18. The assembly of claim 13, wherein the said externally powered means is controlled by a computer.

* * * * *